United States Patent [19]

Schuler et al.

[11] 4,106,424

[45] Aug. 15, 1978

[54] INSULATED MARINE CONTAINER FOR LIQUEFIED GAS

[75] Inventors: Alan L. Schuler, Hingham; David L. Post, South Weymouth, both of Mass.

[73] Assignee: General Dynamics Corporation, St. Louis, Mo.

[21] Appl. No.: 800,702

[22] Filed: May 26, 1977

[51] Int. Cl.[2] ..... B63B 25/08

[52] U.S. Cl. ..... 114/74 A; 220/901

[58] Field of Search ..... 114/74 R, 74 A; 220/8, 220/9 LG, 15; 62/45; 52/309.5

[56] References Cited

U.S. PATENT DOCUMENTS

| | | | |
|---|---|---|---|
| 3,026,577 | 3/1962 | Dosker | 114/74 A |
| 3,583,351 | 6/1971 | Gorman | 114/74 A |
| 3,670,917 | 6/1972 | Nishimaki et al. | 220/9 LG |
| 3,878,658 | 4/1975 | Davis et al. | 114/74 A |
| 3,942,331 | 3/1976 | Newman, Jr. et al. | 62/45 |
| 4,021,982 | 5/1977 | Kotcharian | 220/9 LG |

*Primary Examiner*—Trygve M. Blix
*Assistant Examiner*—Jesus D. Sotelo
*Attorney, Agent, or Firm*—Fitch, Even, Tabin & Luedeka

[57] ABSTRACT

A marine container for holding liquefied gas wherein a metal tank having the general shape of a surface of revolution is designed to contain a liquefied gas by maintaining a low temperature therewithin via a surrounding thermal insulation barrier. A first layer of foamed polymeric panels, each having a predetermined hole pattern, are supported by studs affixed to said exterior surface and extending into the holes. Fibrous insulation fills the remainder of the holes and the joints between the edges of adjacent panels. Heat-insulating posts extend outward from the studs and support a layer of fibrous insulation and a third layer of foamed polymeric panels having an offset hole pattern. Fasteners secure the third layer panels upon the posts. Insulating material is foamed in situ through apertures in the fasteners to fill the holes around the posts.

9 Claims, 7 Drawing Figures

INSULATED MARINE CONTAINER FOR LIQUEFIED GAS extend

This invention relates to large marine containers for shipboard transport and/or storage of liquefied gases and more particularly to a thermal insulation system in combination with such containers for use aboard a ship, barge or the like which system will minimize the flow of ambient heat into the contents of such containers and thus allow the retention of liquefied gas cargo at a temperature at or below its boiling point.

Numerous schemes have been developed for the shipboard transport of liquefied gases in large containers, for example, in spherical tanks which may be 100 feet or more in diameter. One such system is shown in U.S. Pat. No. 3,680,323, issued Aug. 1, 1972, wherein a large spherical tank is supported by a skirt depending from an equatorial ring section which forms a portion of the tank itself. Various systems have been developed for insulating such large shipboard tanks, by disposing thermal insulation either interior or exterior of the metal tank wall in order to maintain the temperature at about or below the boiling point of the liquefied gas so that the pressure within the tank can be maintained within the range of about 1 to 3 atmospheres. U.S. Pat. Nos. 3,828,709 (issued Aug. 13, 1974), 3,855,811 (issued Dec. 24, 1974), and 3,878,658 (issued Apr. 22, 1975) show various insulation systems for maintaining a low temperature within a large tank. However, improved insulation systems for large shipboard tanks, particularly spherical tanks, are constantly being sought after.

The present invention provides an improved insulation system particularly adapted for insulating the exterior of a large spherical metal tank and which will provide excellent thermal insulation characteristics over many years of service. The thermal effectiveness of the insulation system is such that the boil-off of the liquefied gas cargo can be maintained at less than 0.25 percent per day, without the use of any auxiliary refrigeration equipment. The invention further provides an improved method for constructing an insulated tank designed for marine use for the transportation or storage of liquefied gases.

The invention will be more fully understood from the following detailed description of a preferred embodiment, particularly when read in conjunction with the accompanying drawings wherein.

Figure 1:
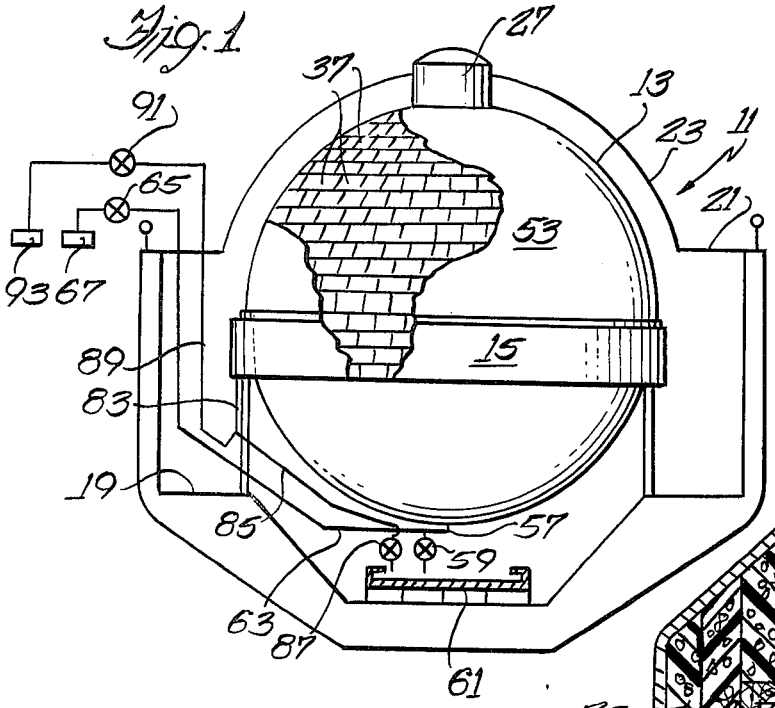
FIG. 1 is a view of a vertical section through the hull of a ship with portions broken away, and with certain diagrammatic additions, to portray a thermal insulation system embodying various features of the invention.

Depicted in FIG. 1 is a ship 11 which contains a plurality of metallic tanks 13, only one of which is shown; however, the other tanks are of similar size and construction. Each of the tanks is spherical and is supported by a depending metal skirt 15 which is integral with the tank as a result of a ring section 17 (FIG. 3.) located at about the equator of the tank 13. Although the structural details of the connection between the skirt and the tank are not shown, they may be of the general type disclosed in U.S. Pat. No. 2,901,592, issued to Rossheim on Aug. 25, 1959. The lower part of the metal skirt 15 is suitably connected, as by welding, to an appropriate part of the hull 19 of the ship. Although the tank 13 is illustrated with this preferred method of support by a depending skirt 15, it should be understood that various alternative support arrangements for a large spherical tank, which are known in the art, may also be employed.

The tank 13 extends upward above the main deck 21 of the ship and is covered by a suitable weather cover 23 which protects the tank and its insulated outer surface from the wind and sea spray encountered on an ocean voyage. The weather cover 23 can also be made airtight so that the region between the tank and the weather cover, as well as the region surrounding the tank within the hull 19 of the ship, can be filled with an inert gas which will provide protection to ship's personnel when the liquefied gas is combustible or otherwise hazardous, e.g., chlorine.

Ships 11 of this general type are presently being constructed for the shipment of liquefied natural gas (LNG), which is primarily methane having a normal boiling point of about −161° C. Thus the insulation system is designed to minimize the heat flow between a metal interior tank, which may be made of aluminum, and which will be at about −161° C. and ambient temperature, which may range between about 0° C. and about 45° C.

Figure 3:
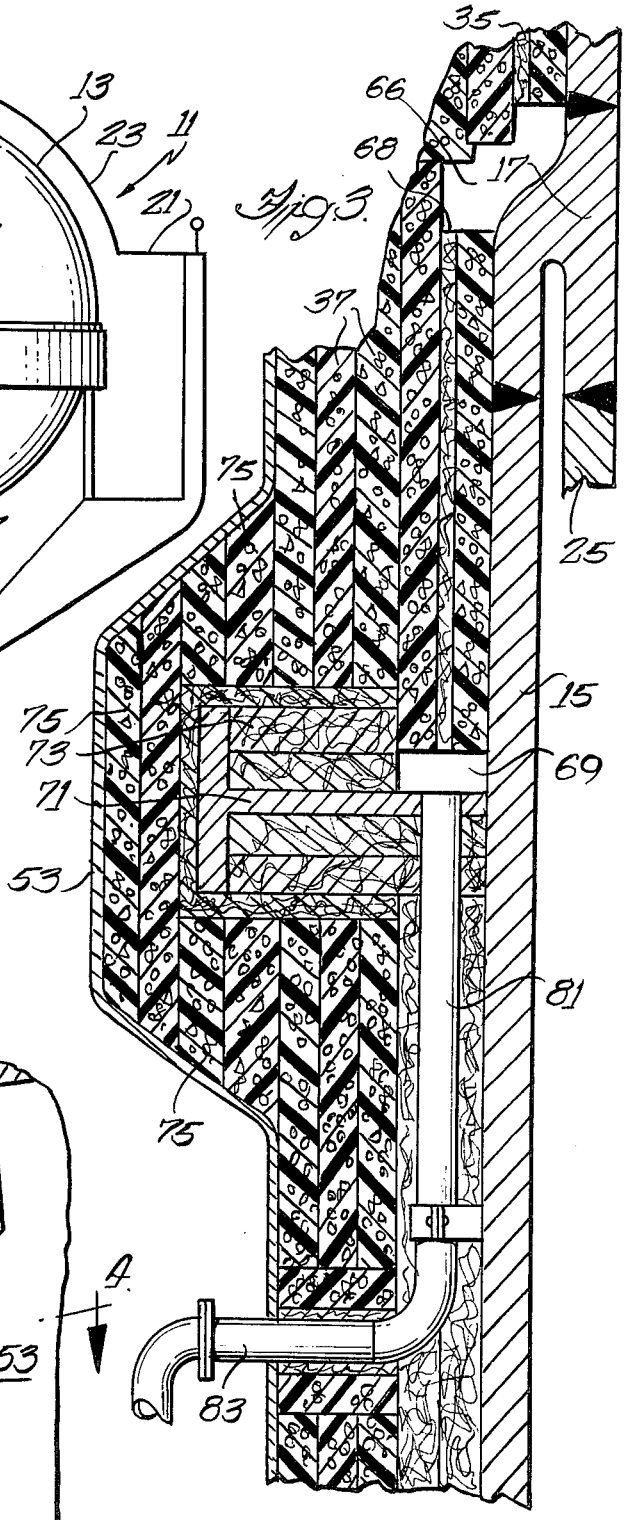
FIG. 3 is an enlarged vertical sectional view showing a portion of the insulated tank of FIG. 1 at a location just below the equator thereof.

The tank 13 includes a spherical metal vessel 25 which may be formed, for example, from plates of aluminum varying between about $1\frac{3}{8}$ in. and 7 in. in thickness that are welded to one another, and which is surmounted by a generally cylindrical dome 27. As shown in FIG. 3, the equatorial section 17 is formed from a ring member which includes an integral extension that connects to the skirt 15. The upper and lower edges of the main body of the ring 17 are appropriately structurally interconnected by welding to the adjacent portions of the upper and lower hemispherical halves of the vessel 25.

Figure 6:
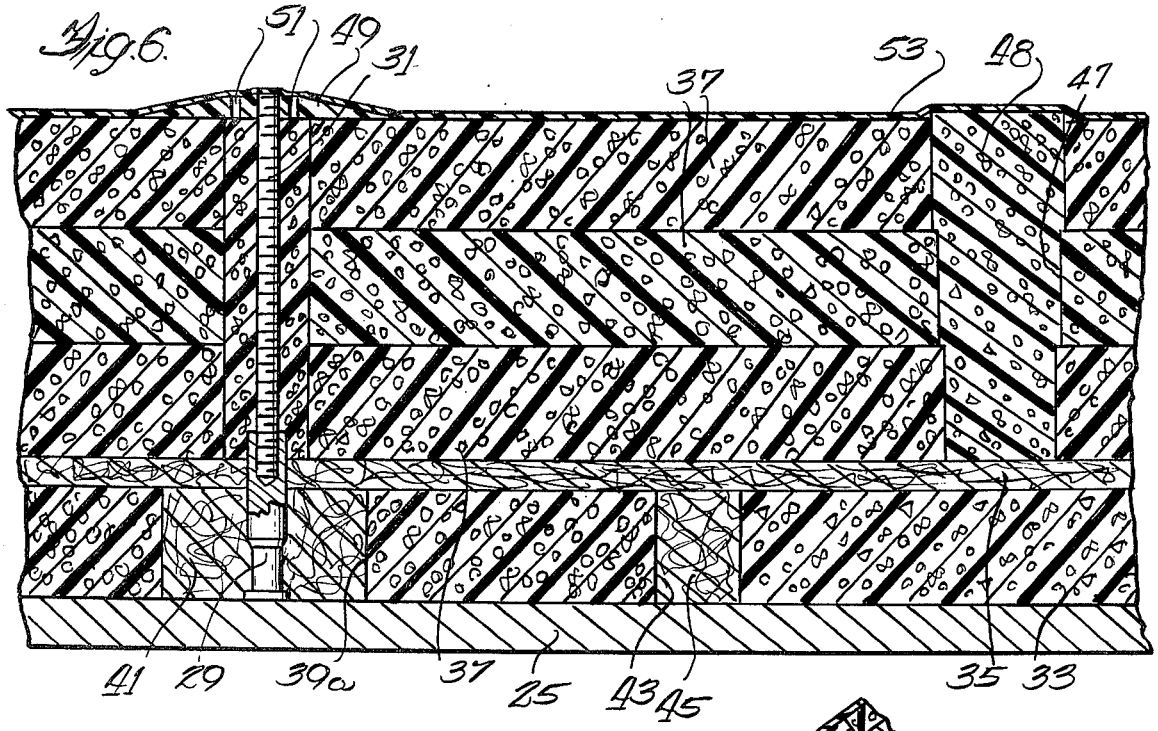
FIG. 6 is an enlarged sectional view of the upper portion of FIG. 5.
Figure 5:
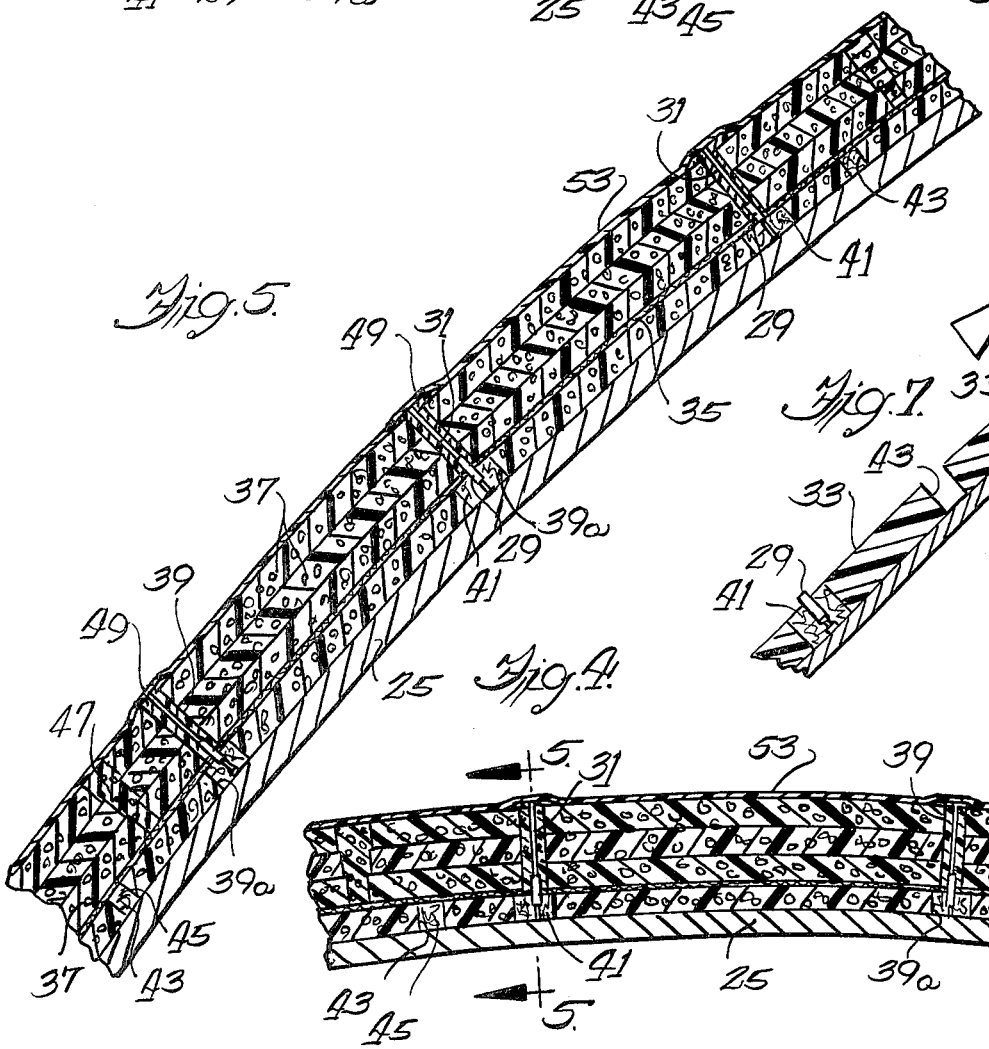
FIG. 5 is a sectional view taken generally along the line 5—5 of FIG. 4.

As evident broadly from FIG. 1, an insulation system located exterior of the metal vessel 25 employs individual panels of a foamed polymeric material, preferably foamed polyurethane which is blown with a fluorocarbon (e.g., a freon), and which preferably has a density between about 1.5 and about 2.5 pounds per cubic foot. As best seen in FIG. 6, the panels are supported on the outer surface of the spherical metal vessel 25 by means of aluminum studs 29 which are welded to the vessel surface using the well known techniques, such as those employed with the Nelson stud, which is discussed further hereinafter. The studs 29 are about 3 inches long and have a threaded hole in their outer end which receives a long threaded post 31 made of a material having good heat-insulation characteristics and adequate structural strength, for example, from a densified, phenolic-impregnated wood laminate, such as that sold by Permali, Inc., or from a thermosetting resin. The posts 31 in the illustrated embodiment are each about 7 inches long.

The insulation system which is used includes three distinct layers. The first or inner layer is made up of a course of 2-inch thick polyurethane panels 33. The second layer is formed from a ½-inch thick fiberglass mat 35. The third layer is made up of 6 inches of polyurethane foam in the form of three courses of 2-inch thick panels 37.

Figure 2:
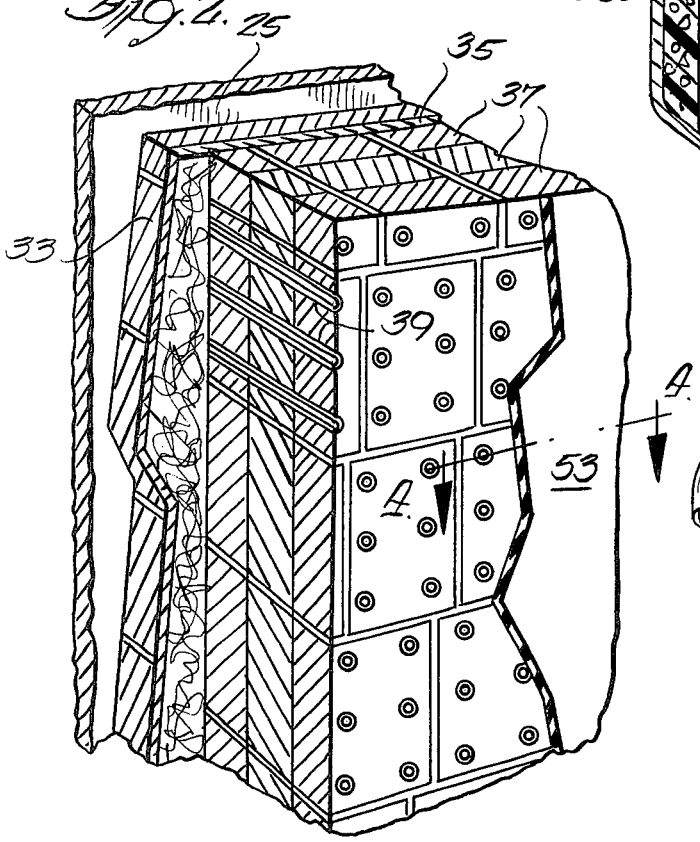
FIG. 2 is an enlarged fragmentary perspective view showing a section of the spherical tank wall with the insulation layers disposed exterior thereof.
Figure 7:
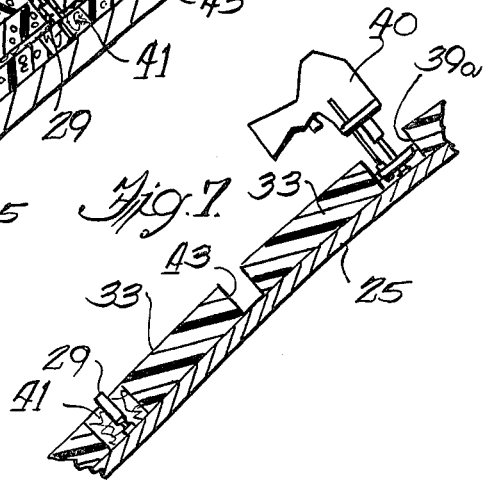
FIG. 7 is a diagrammatic view, generally similar to FIG. 5 illustrating a step in the installation of the insulating system.
Figure 4:
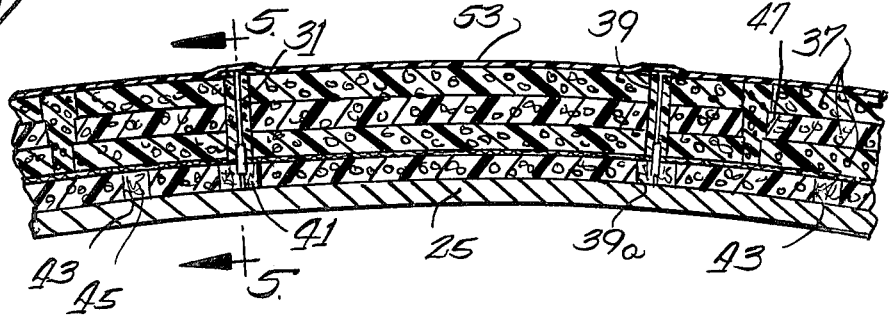
FIG. 4 is a sectional view taken generally along the line 4—4 of FIG. 2.

As best seen in FIG. 2, each of the panels 33,37 is formed with six holes 39 arranged in a specific pattern; although a six-hole pattern is preferred, a four-hole pattern could be used. As best seen in FIG. 6, the holes 39*a* in the first layer of panels 33 are substantially oversize with respect to the studs 29; for example, the studs may be about ⅝ inch in diameter, whereas the holes 39*a* may be about 3½ inches in diameter. This arrangement facilitates the installation of an insulation system of this type upon a very large metallic tank by employing the panels 33 of the first layer as templet for positioning and installing the studs 29. As depicted in FIG. 7, the panels 33 are individually positioned at the desired locations upon exterior surface of the metal vessel 25, and then the head of a stud-welding tool 40 is received in the enlarged holes 39*a* where it is guided by the wall of the hole to affix the stud 29 to the metal tank wall precisely centrally of each of the holes 39*a*. Following installation of the studs 29, the void region of each hole 39*a* is packed with fiberglass 41.

The panels 33,35 are preferably foamed onto a lamination of aluminum foil on kraft paper, with the adhesive qualities of the urethane foam assuring a bood bond to the kraft paper surface, and a similar lamination may also be applied to the opposite surface of the panel. By disposing the panels 33 with this foil layer adjacent the surface of the aluminum vessel 25, it is assured that relative movement can occur therebetween. The attachment of such laminates to one or both surfaces of the panel provides reinforcement and assures the integrity of the unit even if some cracking of the foam should occur late in its lifetime. The panels 33 are proportioned and located so that there is a gap 43 surrounding the entire periphery of each panel, between it and the adjacent panel, of about 1.5 inches, and this gap 43 is filled with fiberglass 45 having a density of about 2 to 3 pounds per cubic foot.

As shown in FIGS. 6 and 7, the welded studs 29 are of such a length as to extend a sufficient distance above the surface of the panels 33 of the first layer to also support the second fiberglass layer 35. This second layer 35 is continuous and is made up of fiberglass about ½ inch thick and having a density of about 2 pounds per cubic foot. The fiberglass layer 35 provides a continuous, thin, hemispherical region or shell just exterior of both the upper half and the lower half of the aluminum vessel 25. Moreover, each of the urethane panels 33 of the first layer is surrounded on all four edges, on its outer surface, and at the boundaries of the six holes 39*a* with fiberglass. The overall arrangement renders the inner layer of panels 33 freely movable and slidable with respect to the outer surface of the metal vessel 25.

As the tank 13 is filled with cryogenic liquid, the aluminum wall of the vessel 25 will thermally contract, and its amount of contraction will be different from that of the polyurethane panel 33 which has a higher coefficient of thermal expansion than aluminum plate. Thus, as the first layer panels 33 shrink relative to the surface of the metal sphere 25, sliding movement at the adjacent surfaces is permitted, and the oversize holes 39*a* allow shifting to occur relative to the welded studs 29 without the creation of structural stresses in the panels that might otherwise arise as a result of differential thermal contraction and expansion.

The long heat-insulating posts 31, when threaded into the studs 29, provide support for the third layer of foamed polyurethane which is 6 inches thick. This 6-inch layer is made up of three 2-inch thick courses of polyurethane panels 37 which have the same characteristics as the panels 33 which are employed in the first layer; alternatively similar panels six inches in thickness could be used. Although, as shown in FIG. 2, each of the panels 37 also has a six-hole pattern, the holes 39 are not only smaller in diameter than the holes 39*a* in the panels 33 of the first layer (see FIG. 6), but they are also located in different positions. As a result, gaps 47 between the peripheral edges of the panels 37 in the third layer are offset or staggered from the gaps 43 between the panels 33 in the first layer, so as to minimize the otherwise open paths between the wall of the metal sphere 25 and the exterior surface of the insulation system. After each group of three 2-inch panels making up the third layer of insulation has been installed over the threaded posts 31, appropriate fasteners 49 are applied to the outer ends of the posts to secure the panels in position.

The illustrated fasteners 49 are relatively flat nuts or torque washers which each have a threaded central hole that mates with the threads on the end of the post 31. The fasteners 49 may be molded from a suitable plastic material, such as an acetyl resin, e.g. Delrin. The fasteners 49 are provided with several passageways 51 (see FIG. 6) which provide communication with the void region between each post 31 and the sidewalls of the holes 39 in the panels 37. Polyurethane is injected into this region, through these passageways 51, and foamed in situ so as to not only totally fill the region with a thermal-insulating material but to also better secure the panels to the posts. After the triplicate panel layer has been installed on a segment of the spherical surface, the gaps 47 between the peripheries of the panels 37 are also filled with foam-in-place polyurethane 48 to provide a totally sealed, 6-inch thick thermal barrier about the second layer of insulation 35.

After all of the panels 37 of the third layer have been installed and after the gaps 47 at the joints between panels 37 and the regions about the posts 31 have been filled with foam-in-place polyurethane, an outer protective covering 53 is applied upon the exterior of the insulated sphere including the supporting skirt 15. This protective covering 53 should be vapor-tight and resistant to the ocean environment. Moreover, inasmuch as it is contemplated that the tanks 13 may be formed and insulated at a facility distant from that at which the hulls of the ships will be built, this outer covering should be capable of providing protection against salt spray and the like while the tanks 13 are shipped, as by barge, to the shipbuilding facility. A sprayable elastomeric material may be used for this protective covering 53, and preferably a layer of a butyl rubber about 25 mils (0.025 in.) thick is uniformly sprayed over the entire outer surface of the insulated tank 13, followed by a thinner outer layer of urethane elastomer.

In addition to providing an extremely effective thermal insulation system that is relatively light in weight (for example, the total insulation for a spherical tank 120 feet in diameter weighs less than 60 tons), the system inherently provides a drainage arrangement which is effective in the unlikely instance that leakage of any liquefied gas should occur through the wall of the metal vessel 25. In this respect, the thin, hemispherical shell, which is provided by the continuous second layer of fiberglass 35, stands ready to serve as passageway to accommodate any leakage flow of liquefied gas. Moreover, the fiberglass 41 which fills the regions surrounding the studs 29 and the fiberglass 45 which fills the gaps 43 between the panels 33 in the first layer provide communication from the exterior surface of the aluminum vessel 25 to this thin, continuous, hemispherical shell.

With respect to the lower half of the tank 13, as particularly shown in FIG. 1, a drainage outlet line 57 is incorporated which extends from the lowermost region of this shell exterior of the insulation system. A piping arrangement connected to this outlet line 57 includes a relief valve 59 which is set to open at a very low pressure, i.e., 9 in. of water (1.02 atm.) and which discharges into an insulated catch basin 61 provided at a lower location in the hull 19 of the ship and disposed centrally beneath each tank. In order to be able to periodically check to detect whether there is any leakage of the cargo, a branch line 63 from the outlet 57 runs to an upper location (as shown diagrammatically in FIG. 1) through a valve 65 to a sampling pump 67. Accordingly, by opening the upper valve 65 and running the sampling pump 67, a slight vacuum can be created in the region of the thin hemispherical shell to detect whether there is any gas (for example, methane) from the cargo present in the shell, which would be indicative of leakage somewhere within the lower hemisphere of the metal vessel.

As illustrated in FIGS. 1 and 3, a similar arrangement is provided with respect to the upper hemisphere. The corresponding, thin fiberglass-filled shell 35 exterior of the upper hemisphere extends downward to a void region 66 which lies exterior of the equatorial ring 17 of the tank. Accordingly, the thin shell 35 serves as a passageway downward to this annular void region 66. An additional fiberglass layer 68 is provided as a part of the insulation system exterior the outer surface of the skirt 15, and it leads to a second void region 69. The skirt 15 is stiffened by a reinforcing ring 71 which is generally T-shaped in cross section and which extends horizontally therefrom. The stiffening ring 71 is appropriately insulated with fiberglass 73 and with polyurethane panels 75, which are appropriately attached by studs and posts (not shown) in the same manner as previously described with respect to the outer surface of the sphere.

A collection conduit 81 is provided at the bottom of the void region 69 and extends through an aperture in the stiffening ring 71 to a lower location where it turns 90° at an elbow and connects to a drainage tube 83 that extends outward through the protective insulation covering and then downward. As shown diagrammatically in FIG. 1, the drainage tube 83 connects to a piping arrangement similar to that previously described. One leg 85 of the piping arrangement extends downward, passing through a suitably provided opening in the skirt, to a relief valve 87 that is disposed above the insulated catch basin 61. The other leg 89 extends upward through a valve 91 to a sampling pump 93, and detection of any leakage can be effected in the same manner as previously described. Moreover, should any significant leakage of the liquefied gas cargo occur, the relief valve will open to discharge the seepage downward to the catch basin 61 where it would be allowed to evaporate or be removed using an eductor or the like.

In addition to providing a vapor-tight barrier about the exterior of the insulated tank, which allows the region between the protective covering 53 and the weather cover 23 to be slightly pressurized with an inert gas, such as nitrogen, for additional safety purposes, the overall insulation system is extremely effective in minimizing heat flow into the liquefied gas cargo. In this respect, with the tank 13 carrying LNG (boiling point of methane about −161° C.), the boil-off at an ambient temperature of about 70° F. exterior of the tank, can be limited to 0.16 percent per day. Such an amount is commercially acceptable and can be efficiently burned as a part of the ship's propulsion system. Moreover, the illustrated and described polyurethane panel system has sufficient compressive strength to allow the insulated tank to be physically supported via a concave base ring to facilitate its movement over land preliminary to its installation aboard a barge or the like for transport to a shipbuilding facility.

Although the invention has been described with respect to certain preferred embodiments, it should be understood that various changes and modifications as would be obvious to one having the ordinary skill in this art may be made without departing from the scope of the invention, which is defined solely by the claims appended hereto. For example, although there are other advantages in utilizing a spherical tank, and although the insulation system can be effectively used with any tank having any shape, it is considered to be particularly advantageous in insulating a tank which is a surface of revolution. Various additional features of the invention are set forth in the claims which follow.

What is claimed is:

1. An insulated marine container for holding liquefied gas which container comprises a metal tank having the general shape of a surface of revolution and designed to contain a liquefied gas by maintaining a low temperature therewithin, means for supporting said tank aboard a marine carrier, and a thermal insulation barrier surrounding the exterior surface of said tank for maintaining said low temperature by minimizing the flow of ambient heat thereinto, which barrier includes a first layer of panels formed of a foamed polymeric material, said panels of said first layer each having at least four holes arranged in a predetermined hole pattern, studs affixed to said exterior surface of said tank having a size substantially smaller than the size of said holes, said panels being disposed with said studs extending into said holes, fibrous insulation filling the region of said holes surrounding said studs, posts of heat-insulating material joined to said studs and extending outward therefrom in axial alignment therewith to form stud-post units, fibrous thermal-insulating material filling the joints between the peripheral edges of adjacent panels of said first layer, a second layer of fibrous insulating material surrounding and in contact with the outer surface of said first layer of panels, said second layer being impaled upon said stud-post units, a third layer of panels formed of a foamed polymeric material, the individual panels of said third layer having holes therethrough of a size larger than necessary to accommodate said posts, which holes are located in the same pattern but in different positions relative to the periphery of the panels than the holes in said first layer panels, so that the joints between panels in said third layer are staggered with respect to the joints between the first layer panels, fasteners connected to the ends of said posts which contact the outer surface of said third layer of panels, said fasteners having apertures which lead to the space between said posts and the interior surface of said holes in said third layer panels, and foamed in situ polymeric insulating material filling said space.

2. The insulated container of claim 1 wherein foamed in situ polymeric material fills the joints between adjacent panels in said third layer.

3. The insulated container of claim 2 wherein a continuous vapor barrier of elastomeric material coats the exterior of said third layer and said fasteners.

4. The insulated container of claim 3 wherein a collection space is provided interior of said vapor barrier, which collection space is in communication with the region of said second layer, and wherein a drain line is provided which extends from said collection space to a location exterior of said vapor barrier, whereby said fibrous insulation layer provides a pathway for any liquefied gas leaking from said tank to said drain line.

5. The insulated container of claim 4 wherein said drain line contains a valve and extends to a catch basin located below said tank.

6. A method for making an insulated marine container for holding liquefied gas by providing a metal tank designed to contain a liquefied gas by maintaining a low temperature therewithin, which tank includes means for its support aboard a marine carrier, and installing a thermal insulation barrier upon the exterior surface of said tank for maintaining said low temperature by minimizing the flow of ambient heat thereinto, wherein the improvement comprises disposing a first layer of panels formed of foamed polymeric material adjacent the tank exterior surface, said first layer panels each having at least four oversize holes arranged in a predetermined pattern, inserting a stud-welding tool into each of said holes and affixing a stud to said metal tank surface centrally of each said hole using said panel as a templet, said studs having a size substantially smaller than said oversize holes, filling the region of said oversize holes surrounding said studs with fibrous insulation, filling the joints between the peripheral edges of adjacent panels of said first layer with fibrous thermal-insulating material, attaching posts of heat-insulating material to said studs so that they extend outward therefrom in axial alignment therewith and form stud-post units, impaling a second layer of fibrous insulating material upon said stud-post units in contact with the outer surface of said first layer of panels, installing a third layer of panels formed of a foamed polymeric material upon said posts, and connecting fasteners to the ends of said posts to secure said third layer of panels in position.

7. A method in accordance with claim 6 wherein said third layer panels have holes therethrough of a size larger than the thickness of said posts, wherein said fasteners contact the outer surface of said third layer panels and have apertures which lead to the space between said posts and the interior surface of said holes in said third layer panels, and wherein polymeric insulating material is injected through said apertures and foamed in situ to fill said space.

8. A method in accordance with claim 7 wherein the joints between adjacent panels in said third layer are filled with foamed in situ polymeric material.

9. A method in accordance with claim 8 wherein a continuous vapor barrier of elastomeric material is applied to overcoat the exterior of said third layer and said fasteners.

* * * * *